US007747191B2

(12) United States Patent
Kawasumi

(10) Patent No.: US 7,747,191 B2
(45) Date of Patent: Jun. 29, 2010

(54) PROCESS CARTRIDGE AND IMAGE FORMING APPARATUS

(75) Inventor: Ryoichi Kawasumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 605 days.

(21) Appl. No.: 10/582,217

(22) PCT Filed: Nov. 4, 2005

(86) PCT No.: PCT/JP2005/020667

§ 371 (c)(1),
(2), (4) Date: Apr. 24, 2007

(87) PCT Pub. No.: WO2006/049325

PCT Pub. Date: May 11, 2006

(65) Prior Publication Data

US 2007/0280727 A1 Dec. 6, 2007

(30) Foreign Application Priority Data

Nov. 5, 2004 (JP) ..... 2004-322260

(51) Int. Cl.
*G03G 21/16* (2006.01)

(52) U.S. Cl. ..... 399/111; 399/117; 399/113

(58) Field of Classification Search ..... 399/113, 399/117, 112

See application file for complete search history.

(56) References Cited

U.S. PATENT DOCUMENTS

| | | | | |
|---|---|---|---|---|
| 6,035,159 | A | 3/2000 | Azuma et al. | 399/111 |
| 6,101,349 | A * | 8/2000 | Ohashi et al. | 399/110 |
| 6,785,492 | B2 * | 8/2004 | Tanizaki et al. | 399/113 |
| 7,187,886 | B2 | 3/2007 | Kawasumi | 399/111 |

FOREIGN PATENT DOCUMENTS

| | | |
|---|---|---|
| JP | 7-219414 A | 8/1995 |
| JP | 9-006210 A | 1/1997 |
| JP | 10-078736 A | 3/1998 |
| JP | 10-104905 | 4/1998 |
| JP | 11-174940 | 7/1999 |

OTHER PUBLICATIONS

Korean Notice of Allowance dated May 29, 2008, in counterpart foreign application.

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

A process cartridge is detachably mountable to a main assembly of the image forming apparatus. The cartridge includes an image bearing member, a developing device developing an electrostatic image formed on the member with a developer, a first receiver receiving a driving force rotating the member from a first transmitter of the main assembly, a second receiver receiving a driving force driving the developing device from a second transmitter of the main assembly. The first receiver and the transmitter are engaged with each other with play in a mounting and demounting direction of the process cartridge, when the driving force is inputted from the first transmitter to the first receiver. When the driving force is inputted from the second transmitter to the second receiver, a part of the process cartridge is urged toward a positioning portion for positioning of the process cartridge relative to the main assembly.

14 Claims, 7 Drawing Sheets

PROCESS CARTRIDGE AND IMAGE FORMING APPARATUS

TECHNICAL FIELD

The present invention relates to a process cartridge including process means for performing an for image forming operation, and an electrophotographic image forming apparatus for forming an image using the process cartridge.

BACKGROUND ART

In the field of an image forming apparatus using an electrophotographic image forming process, a process cartridge type of apparatus unifies a photosensitive member and process means actable on the photosensitive member, such as charging means, developing means, cleaning means or the like) into a cartridge which is detachably mountable to a main assembly of the image forming apparatus. The process cartridge type of apparatus is advantageous in that maintenance of the apparatus can be carried out by the user of the apparatus without a service person, so that operability is remarkably improved. Therefore, the process cartridge type of apparatus is widely used in the field of the image forming apparatus. It is desirable that the process cartridge is mounted to the main assembly of the image forming apparatus with high positional accuracy between the process cartridge and the main assembly of the image forming apparatus, while providing a proper mounting feeling.

In a widely used system for correctly positioning a cartridge relative to the main assembly of the image forming apparatus, a projection is provided on the cartridge, and correspondingly, the main assembly of the apparatus is provided with a positioning portion for engagement with the projection, and when the projection is in engagement with the positioning portion, the cartridge is urged by a spring to assure the support, as disclosed in Japanese Laid-open Patent Application Hei 11-174940.

In another example, as shown in FIG. 9, the drive transmission structure is different.

An axial end of a photosensitive drum 67 is provided with a twisted polygonal prism projection 616, and correspondingly, a coupling end 617 of main assembly side of the image forming apparatus which transmits a driving force to the photosensitive drum 67, is provided with a twisted hole having a polygonal cross-section. When the projection 616 is engaged with the hole, they are rotatable integrally with each other so that a rotational driving force is transmitted, during which a thrust force is produced to pull the projection into the main assembly side of the apparatus by the twisting configuration, and in addition, the axis of the photosensitive drum 67 is positively aligned with the axis of the drum gear 622 by way of the coupling, thus determining the position of the cartridge correctly relative to the main assembly of the apparatus, as disclosed in Japanese Laid-open Patent Application Hei 10-104905.

However, the conventional image forming apparatus involves a problem in the operability in the positioning and removal of the cartridge.

In the spring latch type apparatus disclosed in Japanese Laid-open Patent Application Hei 11-174940, the spring for positioning the cartridge provides a resistance against the falling of the cartridge in the main assembly of the apparatus. If the spring force is reduced, the resistance is reduced, but the positioning force is also reduced, and therefore, doing so is not desirable. As a result, the cartridge may rise, or ride on another element, so that the cartridge might not be positioned correctly. This results in an excessive load applied to the photosensitive drum and to the transfer belt unit disposed opposed thereto, and may lead to damage in the belt within an image forming region thereof, and then, the image formation is adversely influenced.

The structure of Japanese Laid-open Patent Application Hei 10-104905 will be considered. In order to smoothly remove the cartridge, the coupling desirably has already been retracted. To accomplish this, a rotation of the twisted hole is required to disengage from the projection 616, and therefore, a rotation link mechanism is necessary which is interrelated with some operation, with the result of a complicated structure, and therefore, an increase in the number of parts, in the cost and in the limitation of the arrangements of parts.

DISCLOSURE OF THE INVENTION

Accordingly, it is a principal object of the present invention to provide a process cartridge and an image forming apparatus, wherein a high precision positioning between the process cartridge and the main assembly of the image forming apparatus can be accomplished with a simple structure.

According to an aspect of the present invention, there is provided a process cartridge detachably mountable to a main assembly of the image forming apparatus. The process cartridge comprises an image bearing member, a developing device for developing an electrostatic image formed on the image bearing member with a developer, and image bearing member driving force input portion for receiving a driving force for rotating the image bearing member from an image bearing member driving force output portion from the main assembly of the image forming apparatus, and a developing device driving force input portion for receiving a driving force for driving the developing device from a developing device driving force output portion of the main assembly of the image forming apparatus. The image bearing member driving force output portion and the image bearing member driving force input portion are engaged with each other with play in a mounting and demounting direction of the process cartridge, when the driving force is inputted from the image bearing member driving force output portion to the image bearing member driving force input portion. When the driving force is inputted from the developing device driving force output portion to the developing device driving force input portion, a part of the process cartridge is urged toward a positioning portion for positioning of the process cartridge relative to the main assembly.

According to another aspect of the present invention, there is provided an image forming apparatus comprising a process cartridge mounting portion for detachably mounting a process cartridge that includes an image bearing member and a developing device for developing an electrostatic image formed on the image bearing member with a developer. The apparatus also comprises a positioning portion for positioning the process cartridge relative to the image forming apparatus, an electrostatic image forming device for forming an electrostatic image on the image bearing member, an image bearing member driving force output portion for transmitting a driving force for rotating the image bearing member to an image bearing member driving force input portion provided in the process cartridge, and a developing device driving force output portion for transmitting a driving force for driving the developing device to a developing device driving force input portion provided in the process cartridge. The image bearing member driving force output portion and the image bearing member driving force input portion are engaged with each other with play in a mounting and demounting direction of the process cartridge, when the driving force is inputted from the image bearing member driving force output portion to the image bearing member driving force input portion. When the driving force is inputted from the developing device driving force output portion to the developing device driving force input portion, a part of the process cartridge is urged toward the positioning portion.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Referring to FIG. 1 to FIG. 4, a description will be provided as to the embodiments of the present invention. First, a description will be provided as to a general arrangement of the main assembly of the image forming apparatus, and then as to the structure which improves the mounting property of the cartridge to the main assembly of the image forming apparatus, and finally as to the positioning of the cartridge and as to the structure of supporting means.

Figure 3:
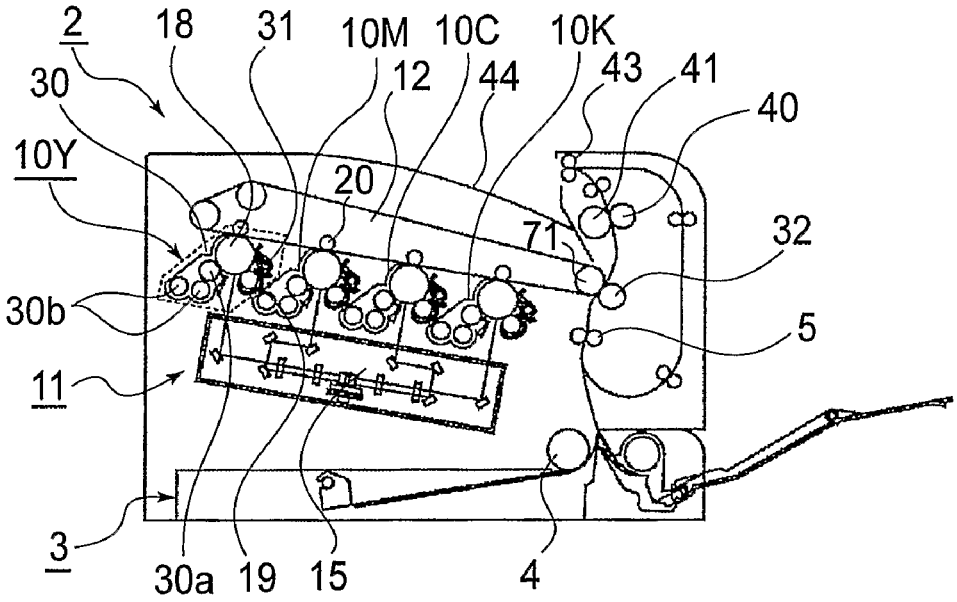
FIG. 3 is a sectional side view of an image forming apparatus according to an embodiment of the present invention.

FIG. 3 is a schematic illustration of an example of a full-color image forming apparatus (full color printer) having an intermediary transfer belt (middle transferring means) of an in-line type, using an electrophotographic type process, wherein the righthand side is a front side of the apparatus.

The image forming apparatus 2 is loaded with four process cartridges 10 arranged in a substantially horizontal line at regular intervals, and the cartridges are for yellow color image formation (10Y), magenta color image formation (10M), cyan color image formation (10C), and black color image formation (10K), respectively.

The cartridge 10 includes a drum type electrophotographic photosensitive member (image bearing member, photosensitive drum) 18 is disposed substantially at the center portion thereof, and around the photosensitive drum, there are provided a primary charger 19, a developing device 30 and a drum cleaning device 31.

Provided opposed to the photosensitive drum 18 is a transfer roller 20 (transferring means). A laser exposure apparatus 11 is disposed below a portion between the primary charger 19 and the developing device 30.

A primary charger 19 (primary charging means) electrically charges the surface of the photosensitive drum 18 uniformly to a predetermined negative polarity by a charging bias voltage applied from a charging bias voltage source (unshown).

The developing device 30 contains toner therein, and functions to develop (visualize) the electrostatic latent image formed on the photosensitive drum 18 by depositing the toner into a toner image. Each of the developing devices includes a developing sleeve 30*a* (developer carrying member) for carrying the developer to a developing zone where the developing sleeve 30*a* is opposed to the photosensitive drum, and a screw 30*b* (toner feeding means) for stirring and feeding the toner. In this embodiment, the developer comprises toner and carrier particles (two component developer).

The transfer roller 20 (primary transferring means) is disposed in an intermediary transfer belt unit 12, and is opposed and urged to the photosensitive drum 18.

A drum cleaning device 31 includes a cleaning blade or the like to remove the untransferred toner remaining after the primary transfer operation from the photosensitive drum 18.

The intermediary transfer belt unit 12 includes an intermediary transfer belt 12*a* (intermediary transfer member), a driving roller 71 which functions as a secondary transfer opposing roller, and the like, and the driving roller 71 is disposed opposed to the secondary transfer roller 32.

Disposed downstream of the secondary transfer roller 32 with respect to the feeding direction of the transfer material P, is a fixing device having a fixing roller 41 and a pressing roller 40, which has a substantially vertical sheet path.

The exposure device 11 includes laser light emitting means for emitting light corresponding to a time series electrical digital pixel signal indicative of the image information, a polygonal lens, a reflection mirror and the like. By exposing the respective photosensitive drums 18, the electrostatic latent images are formed on the surfaces of the respective photosensitive drums 18 charged by the primary chargers 19, for respective colors corresponding to the image information.

Figure 4:
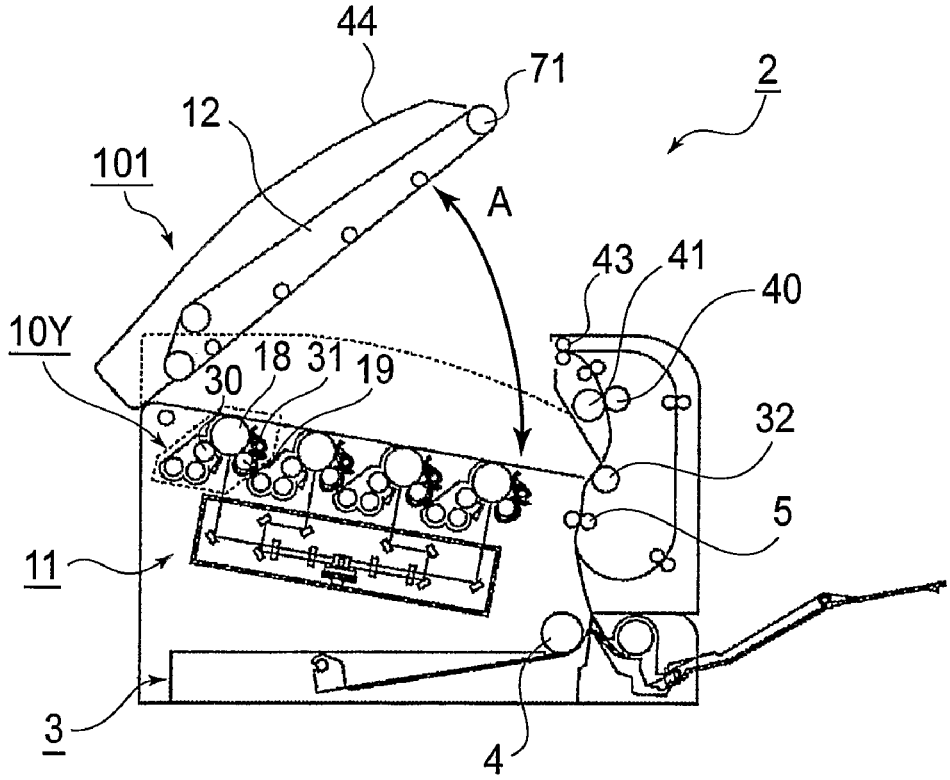
FIG. 4 is addition a sectional side view of an image forming apparatus according to an embodiment of the present invention.

The cartridge 10 and the intermediary transfer belt unit 12 have service lives which are shorter than that of the main assembly of the image forming apparatus 2, and therefore, they have to be exchanged to use the main assembly to its end of the service life of the main assembly. The sheet discharge tray 44 and the intermediary transfer belt unit 12 are constituted into a unit (upper door unit 101) which is movable relative to the main assembly of the image forming apparatus to open and close the apparatus, as shown in FIG. 4. This structure is effective to facilitate exchange of the cartridge 10 and the intermediary transfer belt unit 12. With this structure, the upper door unit 101 is open upwardly (in the direction of an arrow A in FIG. 4), and both of the cartridges 10 and the intermediary transfer belt 12 can be easily removed from and mounted to the main assembly, thus improving the maintenance property. The cartridges are mounted and demounted in a direction substantially perpendicular to the axis of the photosensitive drum 18.

Figure 1:
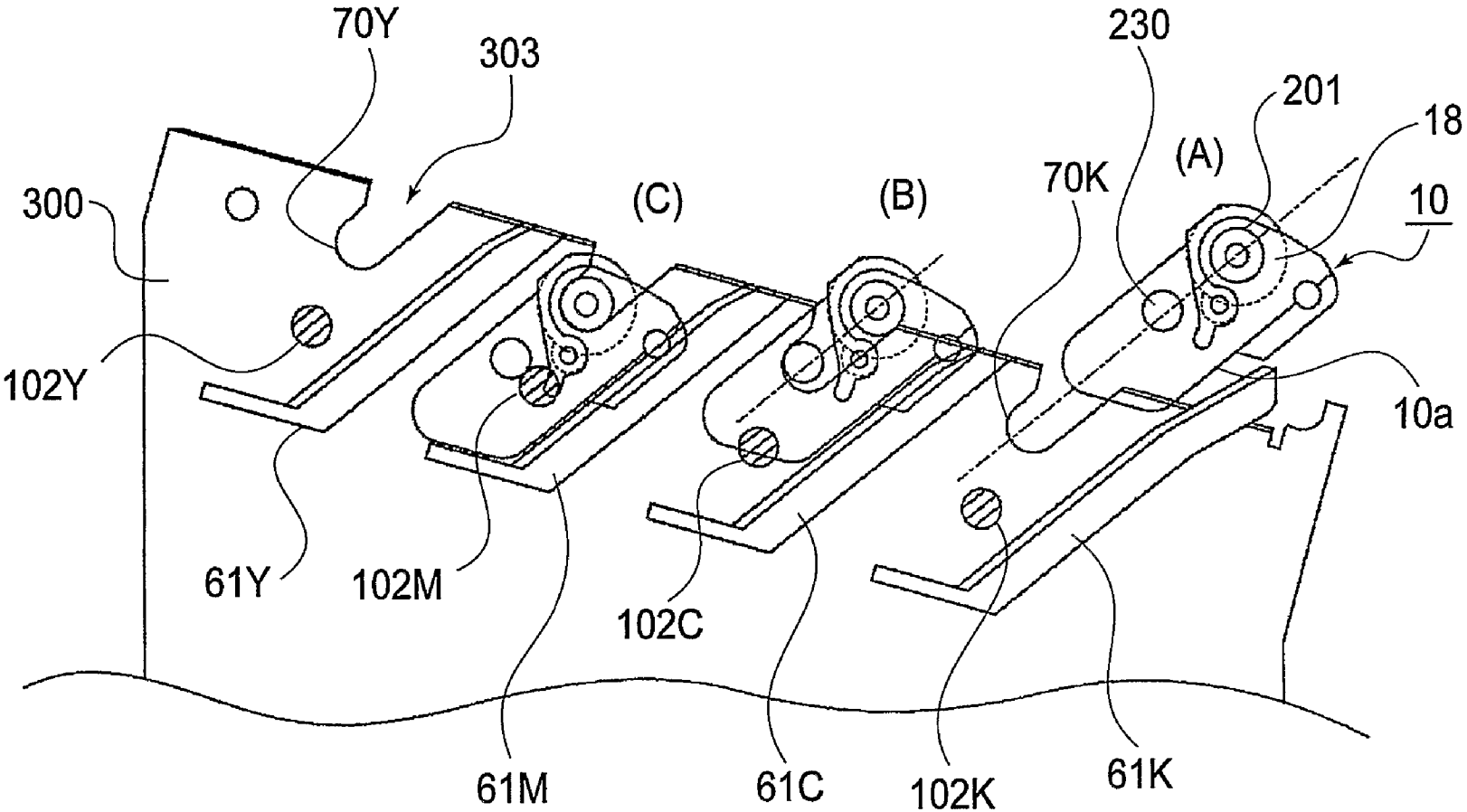
FIG. 1 is a sectional side view of a major part of an image forming apparatus and a process cartridge according to an embodiment of the present invention.
Figure 5:
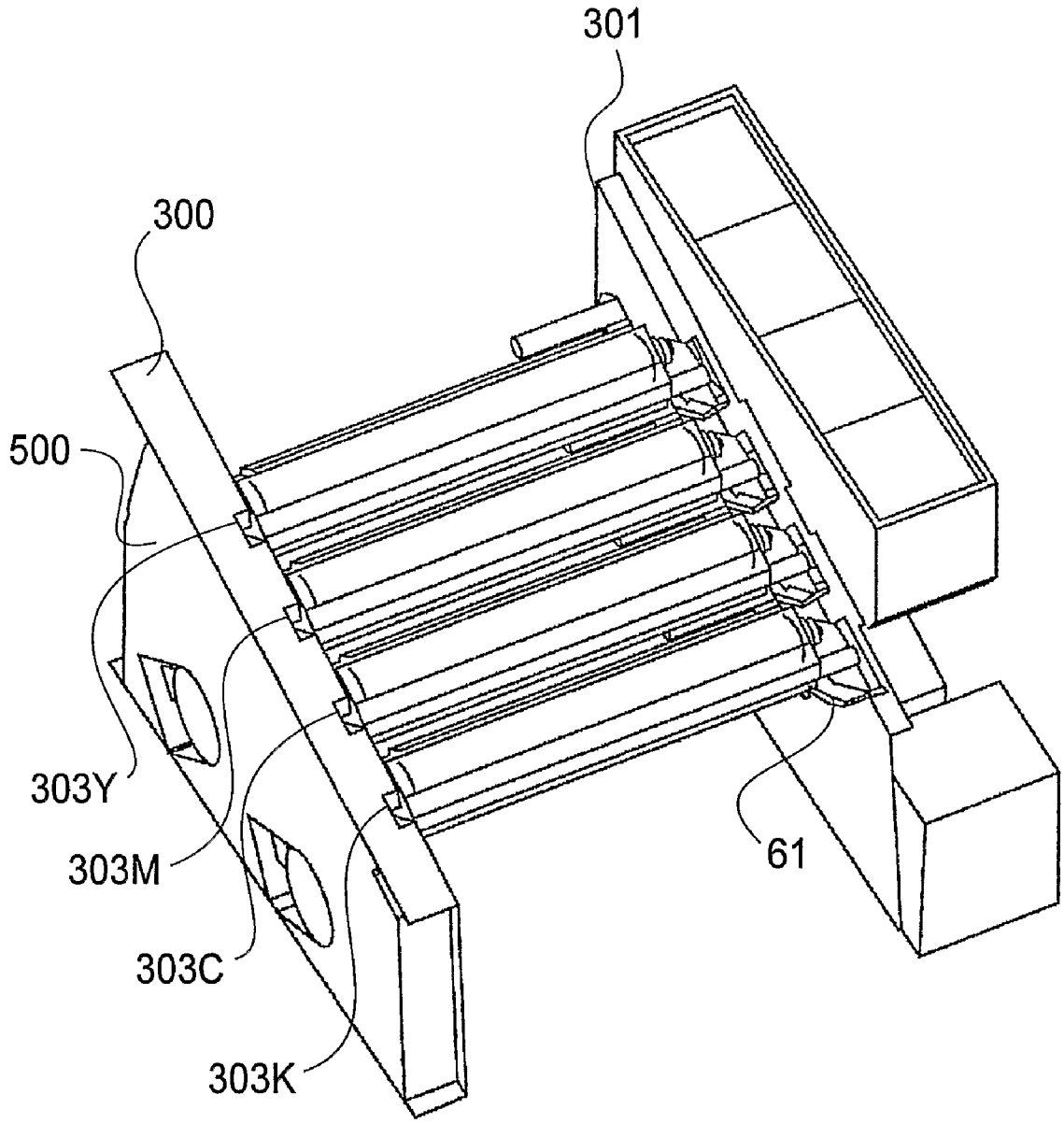
FIG. 5 is a perspective view as seen from an upper part of the image forming apparatus according to an embodiment of the present invention.

As shown in FIG. 1 and FIG. 5, the side plates 300 and 301 of the main assembly of the apparatus are provided with guiding members 61 (61Y, 61M, 61C and 61K), respectively. During the mounting of the process cartridge, the process cartridges slide on the guiding members 61 at the inclined surfaces 10*a* provided at the lower surfaces of the process cartridges 10. In FIG. 5, the direction of the visual line of this perspective view (which is the same as the visual line of the user) is substantially the same as the movement line of the cartridge in the mounting and demounting of the cartridge and as the direction in which the guides 61 extends at an angle. In the mounting of the cartridge, the weight of the cartridge per se is utilized, thus, making the mounting operation easy. In the example of the structures shown in FIG. 3 and FIG. 4, the exposure means (laser exposure apparatus 11, in this example) of the main assembly of the image forming apparatus is disposed substantially vertically below the cartridge, and the transferring means (intermediary transfer belt 12) is disposed at an upper part position. With this structure, the advantages of the present invention is further enhanced.

Referring to FIG. 5 to FIG. 8, the driving for inputting method to the process cartridge 10 will be described.

Figure 6:
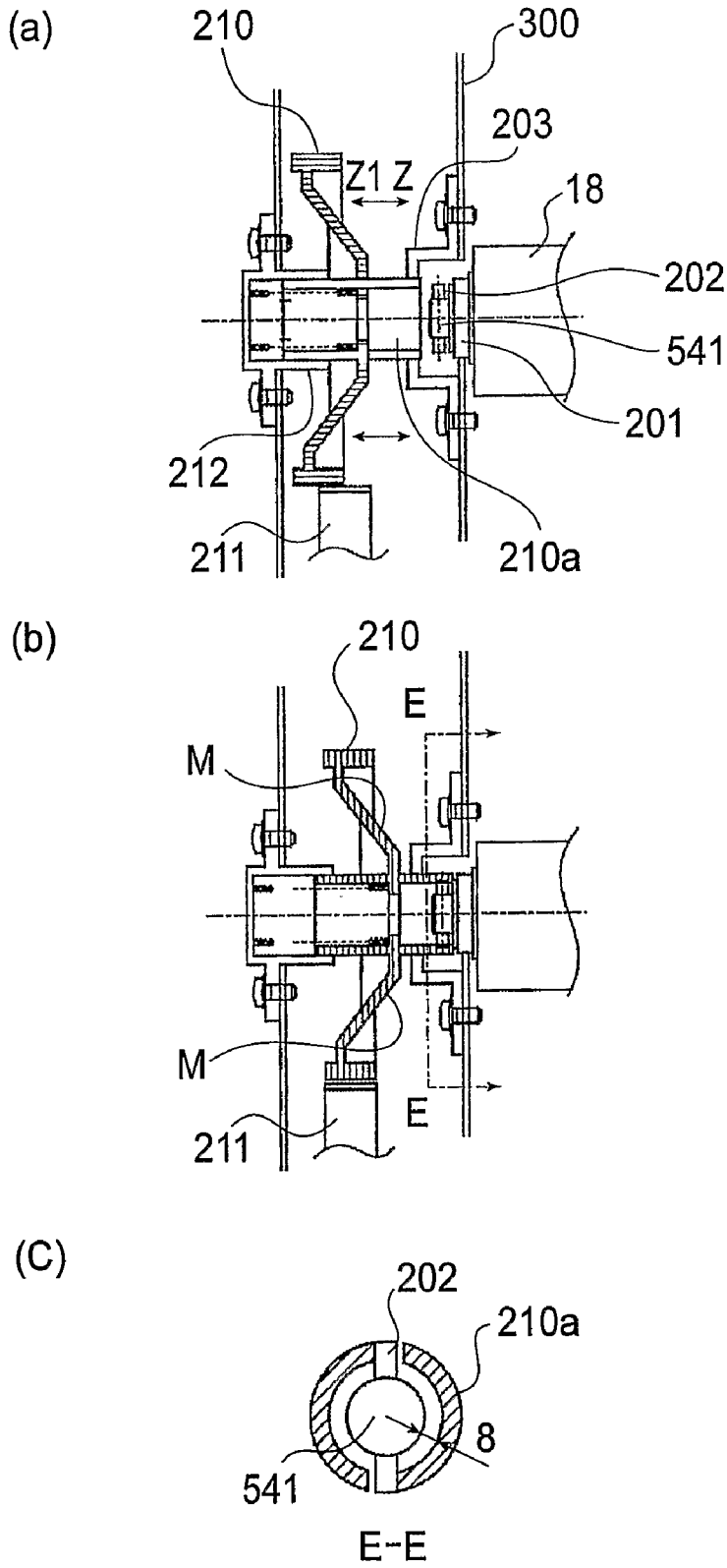
FIGS. 6(*a*)-6(*c*) illustrate a structure for drum driving according to an embodiment of the present invention.
Figure 7:
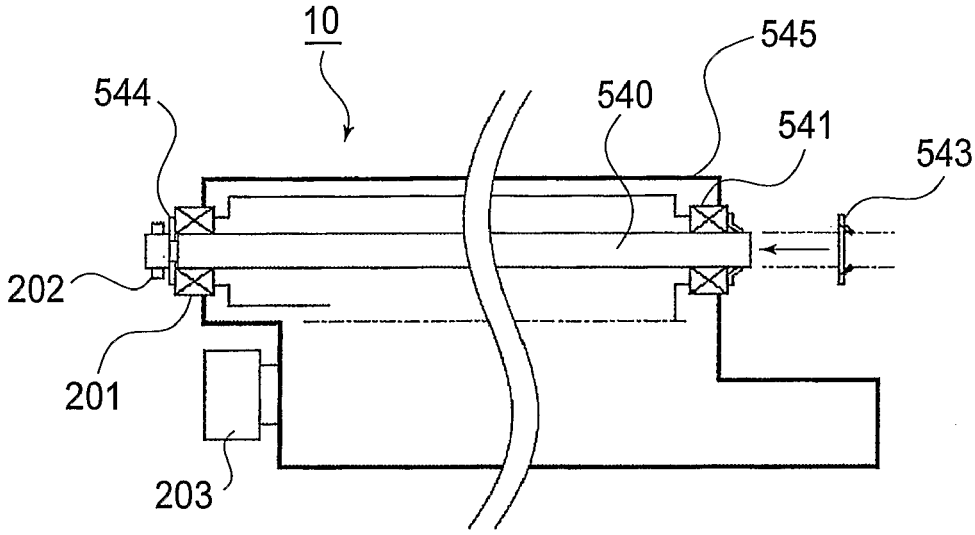
FIG. 7 is a sectional view of a major part of the process cartridge according to an embodiment of the present invention.
Figure 8:
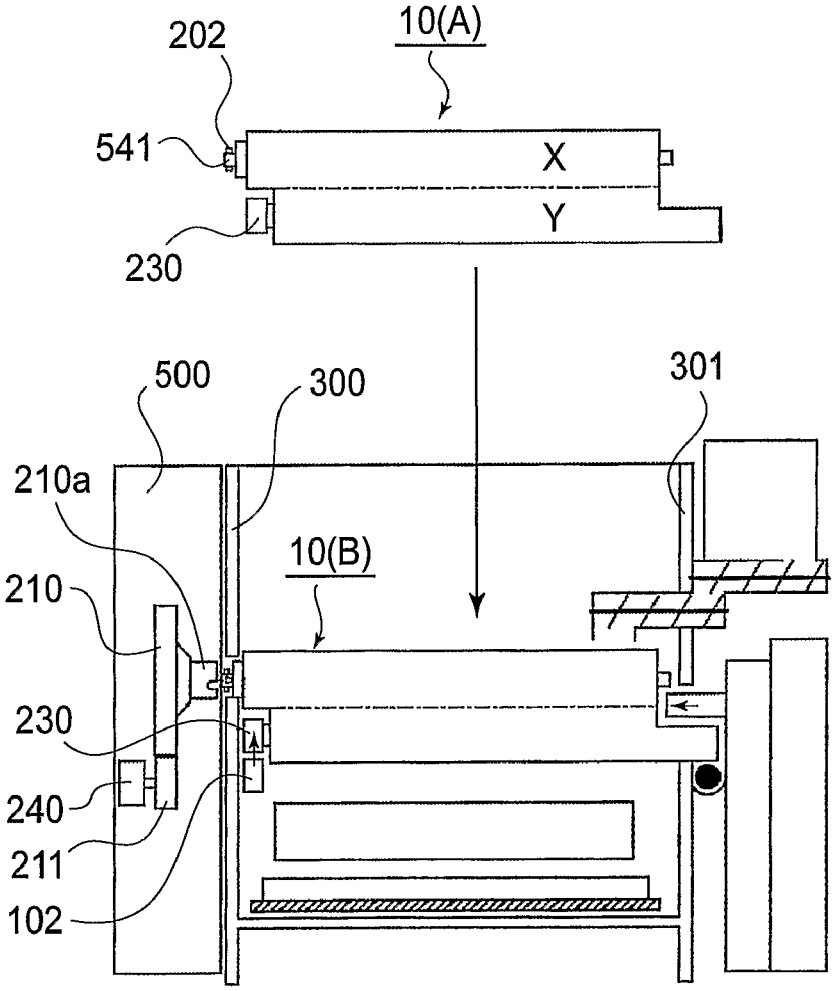
FIG. 8 is a sectional front view of an image forming apparatus according to an embodiment of the present invention.
Figure 9:
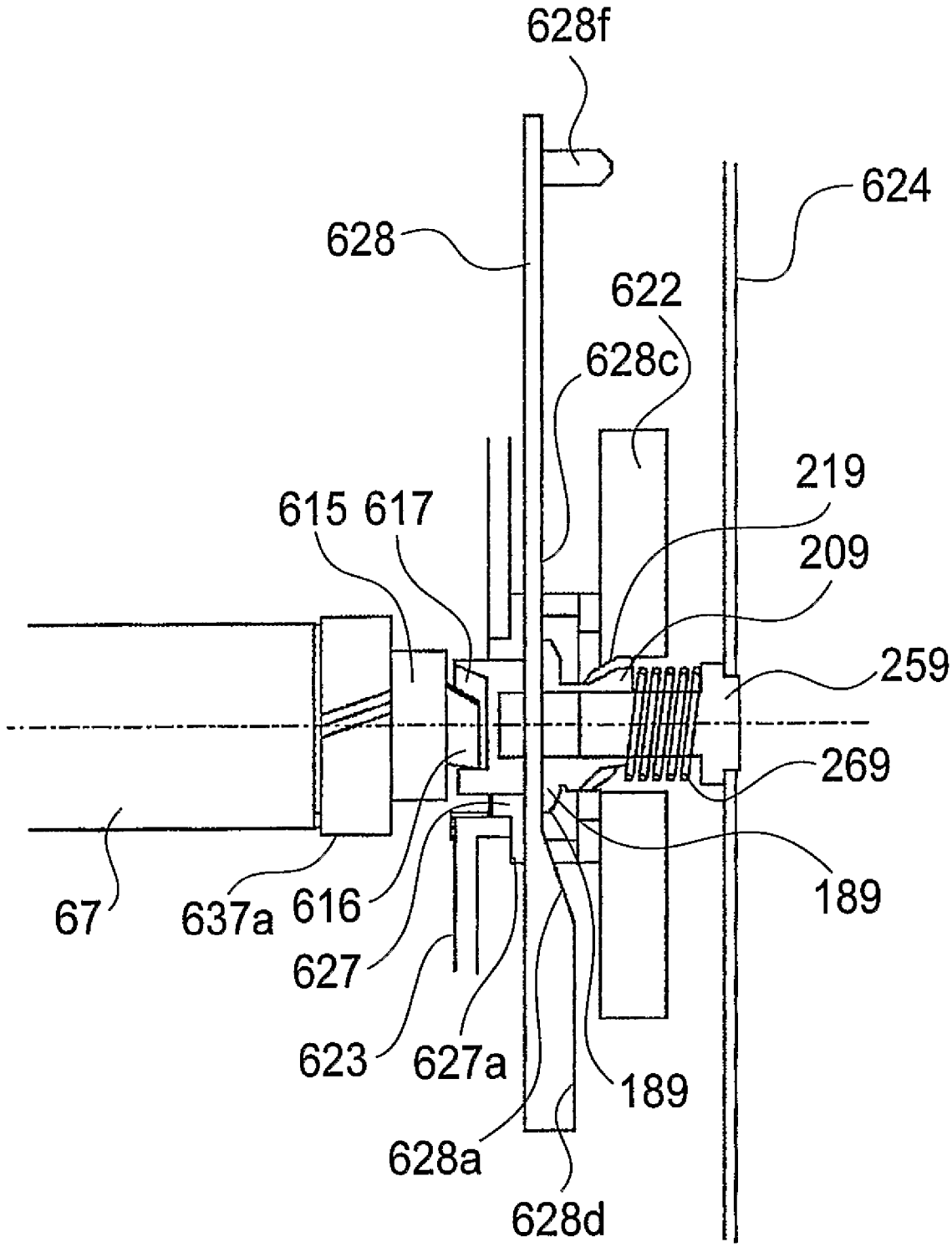
FIG. 9 is a sectional side view of a major part of a process cartridge according to a conventional example.

FIG. 5 is a perspective view; FIGS. 6(*a*)-6(*b*) illustrate a movement structure of the drum gear; FIG. 7 illustrates the structures of the process cartridge 10; and FIG. 8 is a sectional view of the apparatus of the main assembly as seen from the front side of the main assembly.

As shown in FIG. 5, the process cartridge is placed between a left-hand plate 300 and a right-hand plate 301, and the left-hand plate 300 is mounted to the driving unit 500.

FIGS. 6(*a*)-6(*b*) show a structure for driving the drum. A drum gear 210 (image bearing member driving force output portion) is provided in the driving unit 500 to transmit the rotational drive to the photosensitive drum 18. The drum gear 210 is movable in the directions Z and Z1. When the process cartridge is exchanged, it moves in the direction Z1, and when the main assembly is in operation, it moves in the direction Z.

The drum gear 210 is moved in the Z and Z1 directions by an unshown slide lever in the form of a wedge which is engageable with the drum gear 210, for example. For the engagement, an inclined surface M provided on the drum gear 210 in FIG. 6(*b*) is usable such that when the free end of the wedge of the slide lever slides into engagement to the inclined surface M, the drum gear retracts in the direction Z1. In FIG. 6(*a*), the slide lever is engaged with the drum gear 210 between the drum gear 210 and the bearing 203, and in FIG. 6(*b*), the slide lever is in the retracted position.

On the left-hand plate 300, a U-shaped groove 303 (a positioning portion for the cartridge) extends to a position where it is opposed to the drum gear. On the other hand, the photosensitive drum shaft rotatably supports the photosensitive drum, and is press-fitted into a bearing 201 (image bearing member supporting member) having a size for engagement with the U groove 303. Therefore, when the process cartridge is set at the predetermined position, the generating line of the photosensitive drum 18 and the generating line of the drum gear are aligned, and therefore, the driving force becomes transmittable only in the sliding motion of the drum gear in the Z direction.

The rotational driving force transmitted from the motor 240 (driving source) is transmitted to the drum gear 210 through the drive transmission gear 211 and is inputted to the photosensitive drum 18 from the engaging portion 210*a* provided on the drum gear 210 through a pin 202 press-fitted into the photosensitive drum shaft 541. The photosensitive drum shaft 541 and the pin 202 constitute the image bearing member driving force input portion.

With this structure, as contrasted to the above-described prior art structure, the function of alignment between the drum shaft axis and the coupling axis by the twisted polygonal prism projection and the hole is not positively used, but the rotational drive transmission is mainly used. With respect to the positioning of the process cartridge, as shown in FIGS. 6(*a*) and (*b*), by the bearing 201 abutting a bottom of the U-shape groove 303 in the side plate 300 (i.e., the end of the groove 303 of the metal plate 300), the downward motion of the process cartridge is stopped, but the upward motion (cartridge demounting direction) is not limited, and therefore, there is a play. In the state that coupling is engaged, as shown in FIG. 6(*b*), the process cartridge 10 is mounted with a play in the direction of cartridge dismounting direction. As will be understood from FIG. 6(*c*), which is a view taken along a line E-E of FIG. 6(*b*), the pin 202 enters the groove of the drum gear engaging portion 210*a* and is engaged to the drum gear engaging portion 210*a*, and the photosensitive drum 18 is movable within the range of δ provided between the drum gear engaging portion 210*a* and the drum shaft 541, and similarly to the state before the coupling engagement, a play is provided. The range δ is not less than 100 μm in this embodiment. Therefore, the play is not less than 200 μm with respect to a direction perpendicular to the rotational axis of the drum shaft 541. Such selection of the play accomplishes a smooth engagement between the drum gear engaging portion 210*a* and the drum shaft 541 upon drive transmission connection relative to the photosensitive drum. For the purpose of a further smooth engagement, δ is preferably not less than 250 μm. In such a case, the play is not less than 500 μm with respect to the direction perpendicular to the rotational axis of the drum shaft 541.

The groove of the drum gear engaging portion 210*a* and the pin 202 are engaged only in the rotational direction, and therefore, substantially no thrust force is produced in the direction of the axis of the photosensitive drum in the drive transmitting portion. (When the drum gear 210 is a helical gear, a thrust force is produced in the direction of the axis by the meshing engagement between the helical gear and the drive transmission gear 211; but in the present invention, this embodiment employs an engagement between the groove and the pin 202 which are not twisted, and therefore no thrust force is produced).

In the case of engagement between the twisted polygonal prism projection and the twisted hole in the above-described prior art, the photosensitive drum is attracted toward the inside of the main assembly side of the apparatus, by which the play in the direction of the axis of the photosensitive drum 18 is removed. In the embodiment of the present invention, as shown in FIG. 7, for example, the frame 545 of the process cartridge 10 containing the drum shaft 540 fixed to the photosensitive drum 18 is sandwiched by stop rings (movement regulating members) 544 and 543 in the longitudinal direction of the photosensitive drum without play, by which the play in the axis direction of the photosensitive drum 18 can be removed.

The developing device driving structure will be described. FIG. 8 shows a process cartridge 10 (A), wherein the photosensitive drum 18 is disposed mainly in an upper half of the cartridge, and the primary charger 19, the developing device 30 and the drum cleaning device 31 are mainly disposed in a lower half of the cartridge. The developing device includes a developing sleeve 30*a* and a feeding screw 30*b* for circulating the supplied toner. The cartridge further includes a developing device gear (developing device driving force input portion) 230 provided at an end to transmit a driving force to the developing sleeve 30*a* or to the feeding screw 30*b*. On the other hand, the main assembly side of the image forming apparatus includes a driving gear (developing device driving force output portion) 102 for meshing engagement with the developing device gear 230 with an optimum backlash, so that rotational driving force is transmitted from the driving source to the screw through a gear tray. To the developing device driving gear, the output of the motor (driving means), which is unshown, is transmitted. The driving means may receive the driving force from the driving motor 240.

FIG. 8 shows the process cartridge 10 after the process cartridge 10 is mounted to the main assembly (B), wherein the driving transmission paths to the cartridge includes a drum driving path for input in the direction of the axis of the photosensitive drum 18 and the developing device driving path for input from the lower part of the cartridge through the gear. (The primary charger 19 is driven by the drum 18, and the drum cleaning device 31 is driven by the drum driving force branched within the cartridge).

In this embodiment, there is no force limiting the drum in the drum drive transmitting portion as has been described in conjunction with FIGS. 6(*a*)-6(*c*). Therefore, in the state, as shown in FIG. 8, the cartridge can be moved upwardly in the non-driving state and in the driving state. Therefore, no latch spring or the like for fixing the cartridge is provided, and therefore, substantially no load is produced when the process cartridge 10 is mounted into the main assembly of the apparatus. Also, when the process cartridge is taken out, the drum gear 210 is simply moved in the direction of the axis to retract the coupling, and it is not necessary to rotate the coupling or the drum gear 210 for the removal of the process cartridge, so the required structure can be kept at a minimum.

A spring latch or the like may be provided as a rough guide (not positioning means) in the main assembly side of the apparatus to roughly guide the mounting of the process cartridge 10 into the main assembly. When such a latch is used, the latch force is about several 100 gf from the standpoint of a good process cartridge removing property, and such an urging force is so small that upward movability of the process cartridge is not influenced thereby.

Positioning and supporting means, a developing device gear 230 in the cartridge and the driving gear 102 in the main assembly side of the image forming apparatus will be described.

Figure 2:
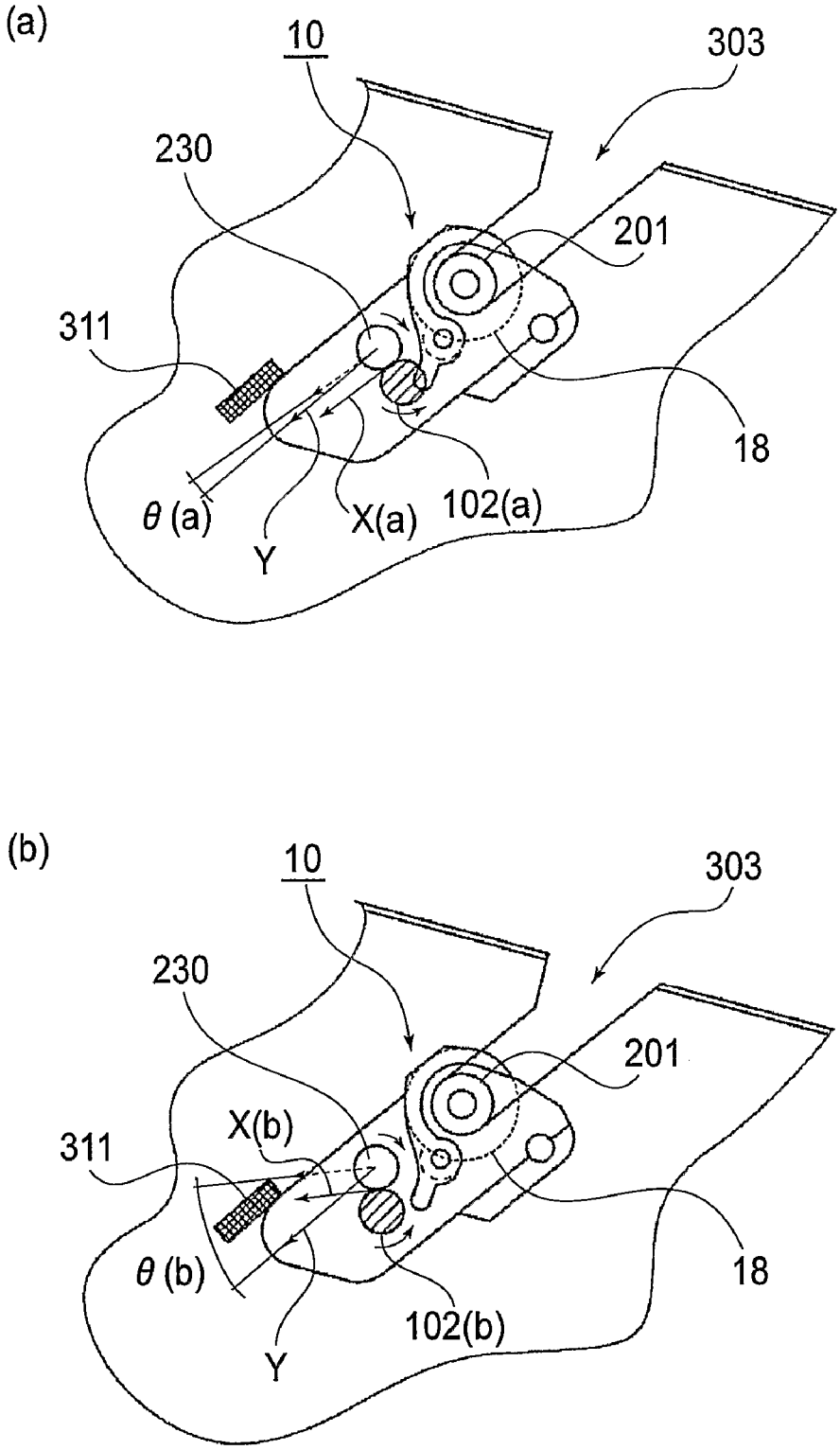
FIGS. 2(*a*) and 2(*b*) are side views of a process cartridge according to the embodiment of the present invention.

Referring back to FIG. 1, the mounting process of the process cartridge 10 to the image forming apparatus is illustrated, and FIGS. 2(*a*) and 2(*b*) show a driving arrangement of the process cartridge 10.

In FIG. 1, the left-hand plate 300 is provided with a U-shaped groove 303 for substantially engaging to and guiding the bearing 201 press-fitted on the drum shaft, and the U-shaped groove 303 has an abutting portion (positioning portion) 70. The abutting portion 70 has a configuration following a part of the outer periphery of the bearing 201. In FIGS. 2(*a*) and 2(*b*), the developing device gear 230 provided in the cartridge is provided at a leading end of the photosensitive drum 18 with respect to the cartridge inserting direction indicated by an arrow Y. The main assembly side of the apparatus is provided with a cartridge regulating member 311 to suppress play at the end of the process cartridge. By such an arrangement, the driving gear 102 in the main assembly side and another member do not interfere with the photosensitive drum 18, and therefore, the mounting property of the cartridge is not influenced. With the arrangement shown in FIGS. 2(*a*) and 2(*b*), when the driving force is transmitted to the developing device gear 230, the direction of the engagement pressure angle (Xa) approaches the inserting direction, and therefore, the force for driving the driving gear 102 is effective to retract the process cartridge 10 toward the inside of the main assembly from the bottom side, and the bearing 201 of the cartridge is urged to the abutting portion 70 along the U groove 303 formed in the main assembly left-hand plate 300 to correctly position the process cartridge.

The angle formed between the developing device gear 230 and the driving gear 102 is preferably in a range to provide a good positioning operation. In FIG. 2(*a*), the arrow Y direction which is the cartridge inserting direction, is substantially the same as the direction N of the force in the direction of the pressure angle (the X (a) direction in FIG. 2(*a*)), by which the component in the direction perpendicular to the direction of the cartridge insertion is very small. Therefore, when an external force is applied to the process cartridge, the external force in the direction of raising the cartridge is reduced by the force X (a), and when an external force is applied in the direction of expanding the distance between the axes of the driving gear 102 (*a*) and the developing device gear 230, the limiting member 311 limits the expansion. However, when the external force is in the direction of reducing the distance between the axes, there is no means to prevent the reduction of the distance. As a result, the developing device gear 230 and the driving gear 102 abut each other at the bottoms of the gear teeth, which is liable to cause a deterioration of the image.

In the example of FIG. 2(*b*), the cartridge inserting direction indicated by the arrow Y and the direction N of the engagement pressure angle in which the force applies (X(b) in FIG. 2, (*b*)) form a predetermined angle θ(b). In this case, the component N2 in the direction perpendicular to the direction of the cartridge insertion is X(b)·sin θ(b), and is in the range of $45° \geqq \theta(b) \geqq 20°$, and as a result, a predetermined proper force is provided within a range not exceeding the component N1 in the inserting direction, so that both of the limitation in the mounting direction and the stabilization of the inter-gear distance are accomplished. For example, even if the external force is applied in the direction of reducing the distance between the driving gear 102 (*b*) and the developing device gear 230, N2(X(b)·sin θ(b)) is effective to cancel the external force, and the vibration or the like can be prevented, and therefore, the arrangement angle is better than the arrangement shown in FIG. 2(*a*). If θ exceeds 45°, the regulating force N1(X(b)·cos θ (b)) in the direction of insertion is so small that regulation in the inserting direction is not sufficient.

Referring back to FIG. 1, the mounting process of the process cartridge 10 will be described in detail. (A) shows a position at which the mounting of the process cartridge 10 starts. Then, the process cartridge 10 is lowered utilizing the weight of the cartridge along the guiding member 61. At the position shown in (B), the bearing 201 on the drum shaft is engaged into the U-shape groove in the left-hand plate 300 of the main assembly, thus determining the position of the cartridge in the front-rear direction of the main assembly of the apparatus. The cartridge is further advanced downward (at this time, the weak urging force of the latch of the rough guide may be available), to the position where the driving gear 102 and the developing device gear 230 are brought into meshing engagement with each other. In the process up to this point, there is hardly any obstruction against the mounting action of the process cartridge, and therefore, the operation is smooth. When the rotational driving forces are transmitted to the developing device gear, the process cartridge 10 is pulled to the predetermined position determined by the abutting portion 70, and during the image forming operation, the driving force is transmitted continuously to the developing device gear 230. Thus, the process cartridge 10 is kept at the correct position.

When the load torque for driving the developing means provided in the process cartridge 10 is large, the pulling force is large, so that process cartridge 10 is positioned and kept by a large force. Furthermore, by selecting the module in the range of 0.8 to 1.0, the gears can be assuredly brought into meshing engagement with each other even if the process cartridge 10 is raised to a certain degree before the start of input of the driving force.

With the above-described structure, a highly accurate positioning and the position maintenance between the process cartridge and the main assembly of the image forming apparatus is accomplished with a simple and low cost structure.

In the above-described embodiment, the surface of the primary transfer provided by the intermediary transfer belt unit 12 and the photosensitive drum 18 in the cartridge 10, is inclined at an angle which may be determined properly by one skilled in the art in consideration of the level of the fixing device, the size of the exposure device 11, or the arrangement may be horizontal (no inclination).

In the foregoing embodiment, the drive transmission mechanism for transmission of the driving force to the photosensitive drum comprises a pin 202 and a drum engaging portion 210*a* having a groove engageable with the pin 202. However, the present invention is not limited to such a structure, and other structures are usable if a play is provided in the mounting and demounting direction of the process cartridge.

INDUSTRIAL APPLICABILITY

As described hereinabove, according the present invention, it is possible to provide a process cartridge and an image forming apparatus, wherein a high precision positioning between the process cartridge and the main assembly of the image forming apparatus can be accomplished with a simple structure.

While the invention has been described with reference to the structures disclosed herein, it is not confined to the details set forth and this application is intended to cover such modifications or changes as may come within the purpose of the improvements or the scope of the following claims.

The invention claimed is:

1. A process cartridge detachably mountable to a main assembly of the image forming apparatus, said process cartridge comprising:

an image bearing member;

a developing device configured and positioned to develop an electrostatic image formed on said image bearing member with a developer;

an image bearing member driving force input portion configured and positioned to receive a driving force for rotating said image bearing member from an image bearing member driving force output portion from the main assembly of the image forming apparatus;

a developing device driving force input portion for receiving a driving force for driving said developing device from a developing device driving force output portion of the main assembly of the image forming apparatus, wherein the image bearing member driving force output portion and said image bearing member driving force input portion are engaged with each other with play in a mounting and demounting direction of said process cartridge, when the driving force for rotating said image bearing member is inputted from said image bearing member driving force output portion to said image bearing member driving force input portion, and wherein when the driving force for rotating said developing device is inputted from said developing device driving force output portion to said developing device driving force input portion, a part of said process cartridge is urged toward a positioning portion that positions said process cartridge relative to the main assembly.

2. An apparatus according to claim 1, wherein the driving force for rotating said developing device is inputted to said developing device driving force input portion by engagement between a driving force output gear of said developing device driving force output portion and a driving force input gear of said developing device driving force input portion, and wherein when the driving force for rotating said developing device is inputted, a force N, in a direction of an engagement pressure angle, to said process cartridge provided by the engagement between said driving force output gear and said driving force input gear, has a component N1 in the mounting direction of said process cartridge and a component N2 in a direction perpendicular to the mounting direction of said process cartridge, and forces N1 and N2 satisfy:

$N1 \geqq N2$.

3. An apparatus according to claim 2, wherein an angle formed between the direction of the engagement pressure angle and the mounting direction is not less than 20° and not more than 45°.

4. An apparatus according to claim 1, wherein said developing device driving force input portion is disposed downstream of said image bearing member driving force input portion in said process cartridge with respect to the mounting direction of said process cartridge.

5. An apparatus according to claim 1, wherein said image bearing member driving force output portion and said image bearing member driving force input portion are constructed such that when the driving force for rotating said image bearing member is inputted, substantially no force is applied from the image bearing member driving force output portion to said image bearing member driving force input portion in a direction of an axis of rotation of said image bearing member.

6. An apparatus according to claim 5, further comprising:

a frame that supports said image bearing member; and a regulating member configured and positioned to regulate movement of said image bearing member in a direction of the axis of rotation of said image bearing member relative to said frame.

7. An apparatus according to claim 1, wherein a part of said process cartridge functions to rotatably support said image bearing member.

8. An image forming apparatus comprising:

a process cartridge mounting portion configured and positioned to detachably mount a process cartridge including an image bearing member and a developing device that develops an electrostatic image formed on said image bearing member with a developer;

a positioning portion configured to position said process cartridge relative to said image forming apparatus;

an electrostatic image forming device configured and positioned to form an electrostatic image on said image bearing member;

an image bearing member driving force output portion configured and positioned to transmit a driving force for rotating said image bearing member to an image bearing member driving force input portion provided in said process cartridge;

a developing device driving force output portion configured and positioned to transmit a driving force for driving said developing device to a developing device driving force input portion provided in said process cartridge, wherein said image bearing member driving force output portion and said image bearing member driving force input portion are engaged with each other with a play in a mounting and demounting direction of said process cartridge, when the driving force for rotating said image bearing member is inputted from said image bearing member driving force output portion to said image bearing member driving force input portion, and wherein when the driving force for rotating said developing device is inputted from said developing device driving force output portion to said developing device driving force input portion, a part of said process cartridge is urged toward the positioning portion.

9. An apparatus according to claim 8, wherein the driving force for rotating said developing device is inputted to said developing device driving force input portion by engagement between a driving force output gear of said developing device driving force output portion and a driving force input gear of said developing device driving force input portion, and wherein when the driving for rotating said developing device force is inputted, a force N, in a direction of an engagement pressure angle, to said process cartridge provided by the engagement between said driving force output gear and said driving force input gear, has a component N1 in the mounting direction of said process cartridge and a component N2 in a direction perpendicular to the mounting direction of said process cartridge, and forces N1 and N2 satisfy:

$N1 \geqq N2$.

10. An apparatus according to claim 9, wherein an angle formed between the direction of the engagement pressure angle and the mounting direction is not less than 20° and not more than 45°.

11. An apparatus according to claim 8, wherein said developing device driving force input portion is disposed downstream of said image bearing member driving force input portion in said process cartridge with respect to the mounting direction of said process cartridge.

12. An apparatus according to claim 8, wherein said image bearing member driving force output portion and said image bearing member driving force input portion are constructed such that when the driving force for rotating said image bearing member is inputted, substantially no force is applied from said image bearing member driving force output portion to said image bearing member driving force input portion in a direction of an axis of rotation of said image bearing member.

13. An apparatus according to claim 12, wherein said process cartridge further includes:

a frame that supports said image bearing member; and a regulating member configured and positioned to regulate movement of said image bearing member in a direction of an axis of rotation of said image bearing member relative to said frame.

14. An apparatus according to claim 8, wherein a part of said process cartridge functions to rotatably support said image bearing member.

* * * * *